US005390924A

United States Patent [19]

Antonious

[11] Patent Number: 5,390,924

[45] Date of Patent: Feb. 21, 1995

[54] IRON-TYPE GOLD CLUB HEAD WITH IMPROVED WEIGHT DISTRIBUTION AT THE REAR CLUB FACE AND UPPER SOLE OF THE CLUB HEAD

[76] Inventor: Anthony J. Antonious, 7738 Calle Facil, Sarasota, Fla. 34238

[21] Appl. No.: 135,507

[22] Filed: Oct. 13, 1993

[51] Int. Cl.[6] ..... A63B 53/04

[52] U.S. Cl. ..... 273/169; 273/167 A; 273/167 H; 273/167 F; 273/174

[58] Field of Search ..... 273/167 R, 78, 169, 273/170, 171, 172, 173, 174, 167 A, 167 D, 167 E, 167 F, 167 H, 77 R, 77 A, 164.1, 194 B; D21/220

[56] References Cited

U.S. PATENT DOCUMENTS

| | | | |
|---|---|---|---|
| 4,332,388 | 6/1982 | Grow | 273/167 A X |
| 4,826,172 | 5/1989 | Antonious . | |
| 4,907,806 | 3/1990 | Antonious . | |
| 4,915,386 | 4/1990 | Antonious . | |
| 4,919,430 | 4/1990 | Antonious . | |
| 4,919,431 | 4/1990 | Antonious . | |
| 4,932,658 | 6/1990 | Antonious . | |
| 4,938,470 | 7/1990 | Antonious . | |
| 5,011,151 | 4/1991 | Antonious . | |
| 5,014,993 | 5/1991 | Antonious . | |
| 5,026,056 | 6/1991 | McNally | 273/167 F X |
| 5,046,733 | 9/1991 | Antonious . | |
| 5,125,662 | 6/1992 | Antonious | 273/167 A |

*Primary Examiner*—Sebastiano Passaniti
*Attorney, Agent, or Firm*—Finnegan, Henderson, Farabow, Garrett & Dunner

[57] ABSTRACT

A iron-type golf club head for hitting a golf ball. The bottom of the sole of the golf club head extends rearwardly away from the leading edge, and the top of the sole extends rearwardly away from the rear club face of the club head and forms a shelf-like surface that intersects with the rear club face of the club head. The golf club head further includes at least two opposing weight members extending outwardly in a rearward direction from the rear club face and along a portion of the shelf-like upper surface of the sole, the weight members being located apart from each other and on opposite sides of the center of percussion of the club head and being further characterized by extending upwardly from the shelf-like upper surface of the sole and along the rear club face to respective points that are spaced below the top ridge of the club head.

8 Claims, 3 Drawing Sheets

IRON-TYPE GOLD CLUB HEAD WITH IMPROVED WEIGHT DISTRIBUTION AT THE REAR CLUB FACE AND UPPER SOLE OF THE CLUB HEAD

BACKGROUND OF THE INVENTION

1. Field of the Invention

The present invention relates to golf club irons, and in particular, to an iron type golf club having an improved weight distribution system at the rear club face and the upper sole of the club head.

2. Description of the Related Art

Iron type golf club heads have been designed with a number of different weighting systems to attempt to improve the attributes and characteristics of the club in various circumstances. Examples of patents which disclose weighting systems for golf club heads include my own U.S. Pat. Nos. 5,046,733; 5,014,993; 5,011,151; 4,938,470; 4,932,658; 4,919,431; 4,919,430; 4,915,386; 4,907,806; and 4,826,172.

SUMMARY OF THE INVENTION

The general object of the present invention is to provide a weighting system for the back and sole of iron-type club heads that improves upon the prior art, including the above described club heads and resultant clubs.

To achieve these and others advantages and in accordance with the purpose of the invention, as embodied and broadly described herein, the invention is directed toward an iron-type golf club head for hitting a golf ball comprising a golf club head having a heel portion, a toe portion, a body, a sole, a top ridge, a planar lofted ball striking face having a loft greater than 12 degrees, a leading edge defined by the intersection of the ball striking face and the forwardmost progression of the bottom sole, and a rear club face. The bottom of the sole of the golf club head of the present invention extends rearwardly away from the leading edge, and the top of the sole extends rearwardly away from the rear club face of the club head and forms a shelf-like surface that intersects with the rear club face of the club head. The golf club head further includes at least two opposing weight members extending outwardly in a rearward direction from the rear club face and along at least a portion of the shelf-like upper surface of the sole, the weight members being located apart from each other and on opposite sides of the center of gravity of the club head and being further characterized by extending upwardly from the shelf-like upper surface of the sole and along the rear club face to respective points that are spaced below the top ridge of the club head, thereby providing increased weight distribution at the bottom portion of the club head.

In a preferred embodiment, the weight members do not extend upwardly beyond the upper half of the club head in a sole to top ridge direction, and in a most preferred embodiment the weight members do not extend beyond the club head's center of percussion in a sole to top ridge direction. In one preferred embodiment the club head includes perimeter weighting extending from the rear club face at the toe and heel portions of the club, and the weight members are spaced from the perimeter weighting at both the toe and the heel. In another embodiment, the club head includes perimeter weighting extending from the rear club face at the toe and heel portions of the club, and the weight members are respectively connected with the perimeter weighting at the toe and the heel.

In still another embodiment the club head includes a pair of runners extending outwardly from the sole in a top ridge to sole direction and extending rearwardly from the leading edge toward the rear portion of the sole, and the weight members are aligned with the pair of runners, thereby providing an increased weight distribution both above and below the leading edge of the club head. In yet another preferred embodiment, the club head includes an additional weight member which is generally in alignment with the club head's center of gravity and which extends rearwardly from the rear club face and along at least a portion of the shelf-like surface of the sole.

The combination of these as well as other structural innovations described in this application permits a golfer to achieve optimum transfer of potential force at impact. This represents a significant improvement, particularly when ball contact is made toward or at the bottom of the club face proximate the leading edge. The use of two balanced weight members on opposite sides of the club head's center of gravity also provides a substantially enlarged "sweet spot" area. Since effective ball contact can be made over a larger area on the club face, the confidence a golfer will develop with such clubs results in more effective club head contact repeatedly, which will produce more solid shots that travel straighter and further on a consistent basis.

Additional features and advantages of the invention will be set forth in the description which follows, and in part will be apparent from the description, or may be learned by practice of the invention. The objects and other advantages of the invention will be realized and obtained by the combinations particularly pointed out in the written description and claims, as well as the drawings.

Both the foregoing general description and the following detailed description are exemplary and explanatory only. The accompanying drawings are included to provide a further understanding of the invention and are incorporated in and constitute part of the specification to illustrate several embodiments of the invention and, together with the description, serve to explain the principles of the invention.

DETAILED DESCRIPTION OF THE INVENTION

Reference will now be made in detail to the present preferred embodiments of the invention, examples of which are illustrated in the accompanying drawings. Wherever possible, like references will be used to refer to like parts.

Figure 1:
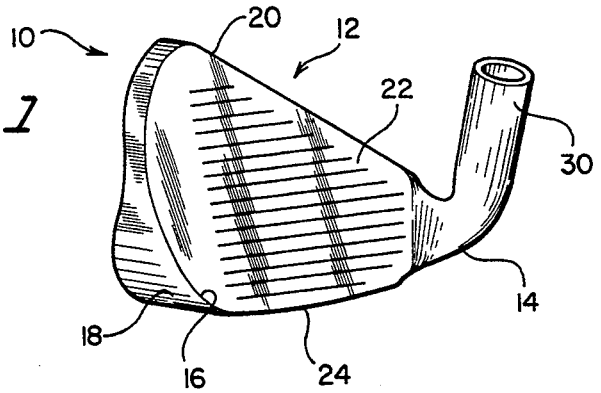
FIG. 1 is a front perspective view of an iron-type club head according to the present invention.
Figure 2:
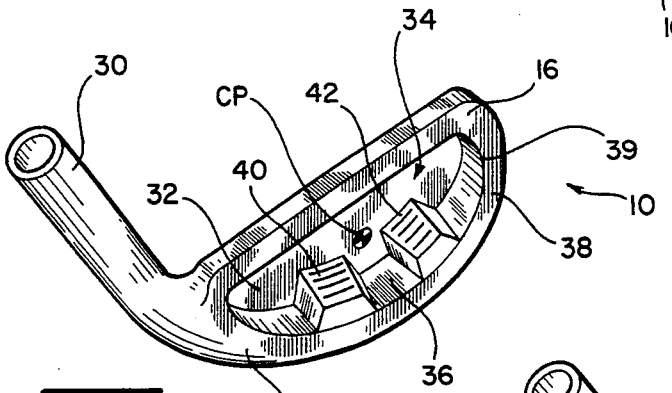
FIG. 2 is a rear perspective view of the iron-type golf club head shown in FIG. 1.
Figure 10:
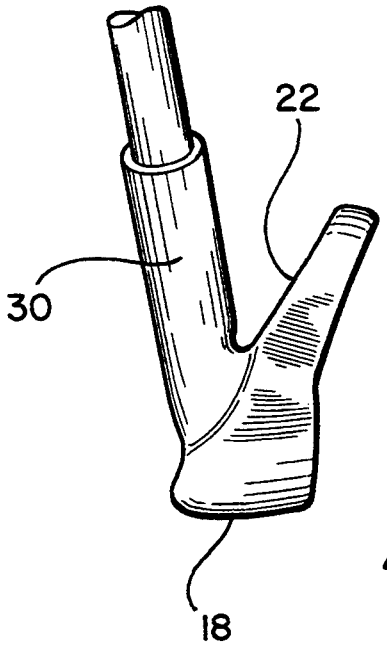
FIG. 10 is an end (heel) elevation view of the present invention.

FIGS. 1, 2, and 10 illustrate a first embodiment of a golf club head 10 made in accordance with the present invention. While the illustrated golf club head is a cavity-back weighted golf head with perimeter weighting around the entire circumference, the present invention can also be applied to other iron-type club heads. The golf club head includes a golf club head body 12 having a heel portion 14, a toe portion 16, a sole 18, a top ridge 20, a hosel 30, a planar lofted ball striking face 22 having a loft greater than 12 degrees, and a complementary rear club face 32. The ball striking face 22 intersects with a forwardmost progression of the bottom sole 18 to define a leading edge 24 of the golf club face. The bottom of the sole 18 extends rearwardly away from the leading edge 24, to the rearmost edge 39 of the club head and projects beyond the extended plane of the rear club face 32. The top surface of the sole 18 extends rearwardly away from the rear club face 32 of the club head and forms a shelf-like surface 36 that intersects with the rear club face 32 of the club head at approximately a 90° angle. The shelf-like surface 36 is preferably at least $\frac{1}{4}$ inch deep (in a striking face to rear club face direction) and more preferably is at least $\frac{1}{2}$ inch deep.

As illustrated in the drawings, the club head 10 has a center of percussion CP shown on the rear club face 32 of the club head. The center of percussion CP is located at approximately the center of the club head and is the spot where a ball should be struck to provide maximum distance and control. The club head 10 includes a rear recess or cavity 34 which is surrounded peripherally by a peripheral mass 38. The peripheral mass 38 concentrates the weight of the club head around the periphery of the club.

As illustrated in FIG. 2, the club head 10 includes first and second weight members 40, 42 spaced from and on opposing sides of the center of percussion CP and extending outwardly in a rearward direction from the rear club face 32 along the shelf-like upper surface 36 of the upper sole to the edge 39 of the peripheral mass 38. The particular weight members 40, 42 shown in FIG. 2 have a substantially trapezoidally shaped cross-section and extend from the shelf-like upper surface 36 of the sole 18 up to a point short of intersecting with the top ridge 20. Preferably, the weight members 40, 42 do not extend upwardly beyond the upper half of the club head in a sole to top ridge direction, and more preferably the weight members 40, 42 do not extend beyond the club head's center of percussion in a sole to top ridge direction.

In the embodiment shown in FIGS. 1 and 2, the weight members 40, 42 are of equal size and extend upward to a point substantially in line with the clubhead's center of percussion and extend rearward along the entire depth of the shelf-like surface 36. The weight members 40, 42 shown in FIGS. 1 and 2 preferably have a maximum width (in the toe to heel direction) and height (in a sole to top ridge direction) of at least $\frac{1}{4}$ inch and most preferably have a maximum width and height of at least $\frac{3}{8}$ inch. The weight members 40, 42 shown in FIGS. 1 and 2 have a length (in the striking face to rear club face direction) of at least $\frac{1}{4}$ inch and most preferably have a length of at least $\frac{3}{8}$ inch. Further, in the embodiment shown in FIGS. 1 and 2, the weight members 40, 42 have a greater height where they intersect with the rear club face, and the weight members progressively decrease in height as they extend rearwardly.

The weight members 40, 42 spaced from and on opposite sides of the center of percussion CP, in combination with the other structural elements, provide a balanced, added mass at the bottom of the club head and a substantially enlarged sweet spot area for more effective club contact. Because the weight members are integral with the rear face 32 and the shelf-like surface 36, they also increase the strength and stability of the club head, particularly about the enlarged sweet spot, and provide a more solid feel.

Figure 3:
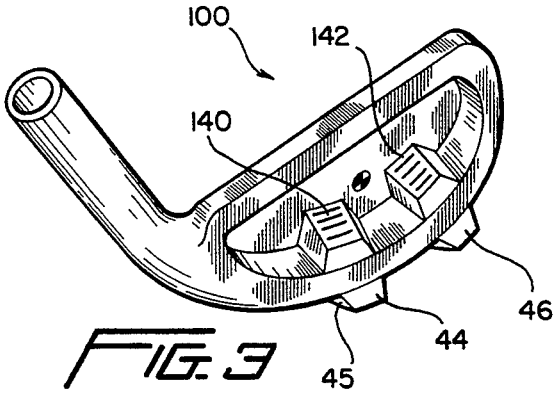
FIG. 3 is a rear perspective view of a second embodiment of the present invention.
Figure 11:
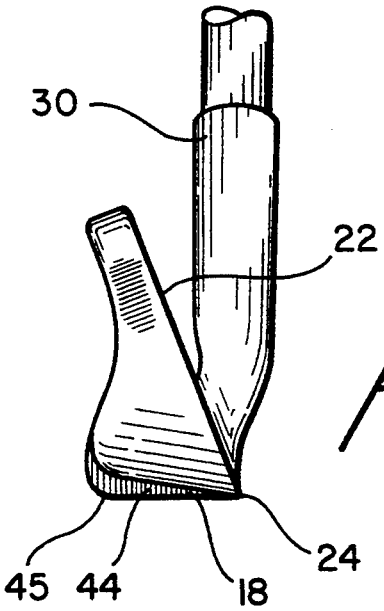
FIG. 11 is an end (toe) elevation view of the present invention, with a runner on the sole shown.

FIGS. 3 and 11 illustrate a second embodiment of a golf club head in accordance with the present invention. This golf club head is similar to that shown in FIGS. 1 and 2, except that the club head 100 includes a pair of runners 44, 46 located on the sole 18. Each of the runners 44, 46 are generally rectangular in shape having a raised flat or radiused ground engaging surface and edges which are smooth or radial in shape to provide minimum resistance when they engage any ground surface obstacles as the club head is swung. The forward portion of the ground engaging surfaces are coincident with the leading edge 24 at that point, and the runners 44, 46 increase in height progressively further from the sole in the front to rear direction, thereby raising the sole above the ground surface. The tapering of the members 44, 46 form sides 45 which increase in size from the front to rear direction. The weight members 140, 142 are aligned with runners 44, 46, thereby providing an increased weight distribution both above and below the leading edge of the club head. It will be appreciated that with the sole raised above the ground by the formation of runners on the sole, the golf club, when it is swung to execute a golf shot, will not have a tendency to either dig into the ground surface or to bounce when contacting the ground surface because of the minimum amount of surface engaging area on the runners. The combined runners and weight members allow crisp contact of the ball at the lower portion of the striking face and provides a significant, balanced mass directly behind the ball as it is struck.

Figure 4:
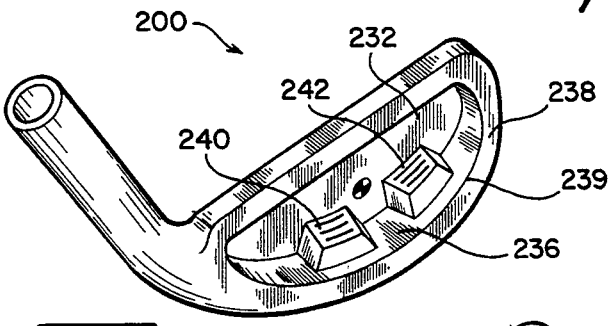
FIG. 4 is a rear perspective view of a third embodiment of the present invention.

FIG. 4 illustrates a third embodiment of a golf club head in accordance with the present invention. This golf club head 200 is similar to that shown in FIGS. 1 and 2, except that the first and second weight members 240, 242 extend only partially along the upper shelf-like surface 236, from the rear club face 232 rearwardly toward the edge 239 of the peripheral mass 238. In this embodiment, the weight members preferably extend rearwardly at least $\frac{1}{4}$ inch from the rear face.

Figure 5:
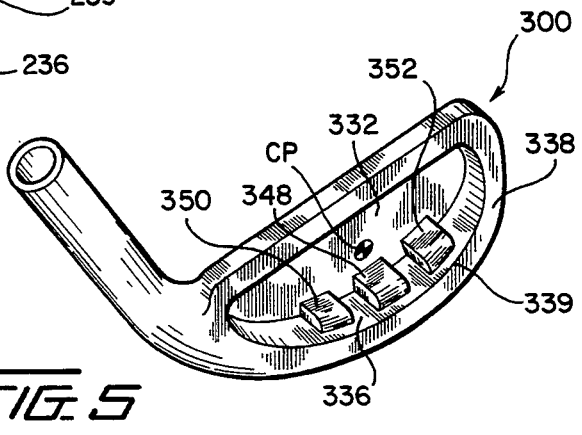
FIG. 5 is a rear perspective view of a fourth embodiment of the present invention.

FIG. 5 illustrates another embodiment of the present invention. The golf club head 300 includes two weight members 350, 352 on opposite sides of the center of percussion CP. In addition, there is a third weight member 348 generally in alignment with the club head's center of percussion CP. All three weight members 350, 352, 348 extend rearwardly from the rear club face 332 along the upper shelf-like surface 336 of the sole to at least partially toward the edge 339 of the peripheral mass 338. As illustrated, these weight members progressively decrease in height as they extend rearwardly, and the weight members have curved upper surfaces which provide a smooth transition of weight distribution. Each of the weight members has a height and width of at least $\frac{1}{4}$ inch. The weight members extend in the sole to top ridge direction to a point below the center of gravity. The additional weight member 348 provides extra weight distribution immediately below the center of gravity.

Figure 6:
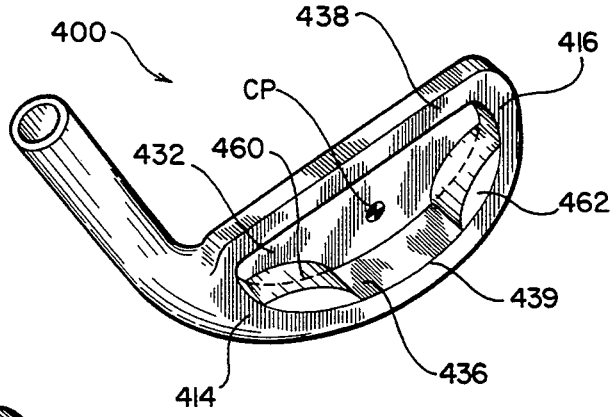
FIG. 6 is a rear perspective view of a fifth embodiment of the present invention.

In the embodiment shown in FIG. 6, the golf club head 400 includes two weight members 460, 462 which extend into the heel 414 and toe 416 portions, respectively. The weight members 460, 462 have a substantially arched cross section and are positioned on opposing sides of the center of percussion CP. The weight members extend outwardly in a rearward direction from the rear club face 432 along the shelf-like upper surface 436 to the edge 439 of the peripheral mass 438 to join the peripheral mass. These weight members have a maximum height of at least $\frac{1}{4}$ inch.

Figure 7:
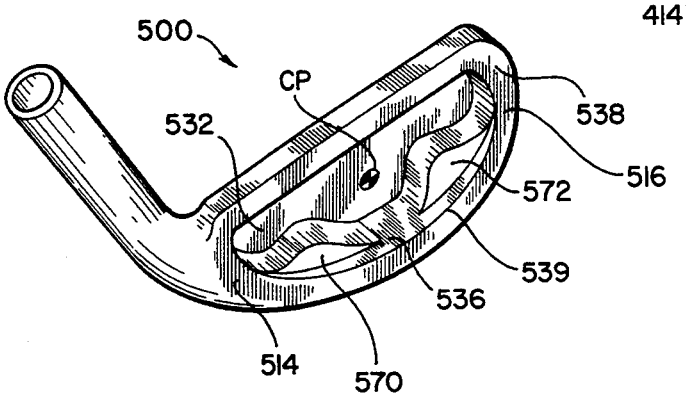
FIG. 7 is a rear perspective view of a sixth embodiment of the present invention.

FIG. 7 illustrates another embodiment of the present invention. The golf club head 500 includes two weight members 570, 572 which are spaced from and located on opposite sides of the center of percussion and are also spaced from the edge of the peripheral mass 538. The weight members 570, 572 have a cross section substantially shaped like a sine function and preferably have a maximum height of at least $\frac{1}{4}$ inch. The weight members extend outwardly in a rearward direction from the rear club face 532 along the shelf-like upper surface 536 and are spaced from the edge 539 of the peripheral mass 538. The weight members preferably have a length of at least $\frac{1}{4}$ inch.

Figure 8:
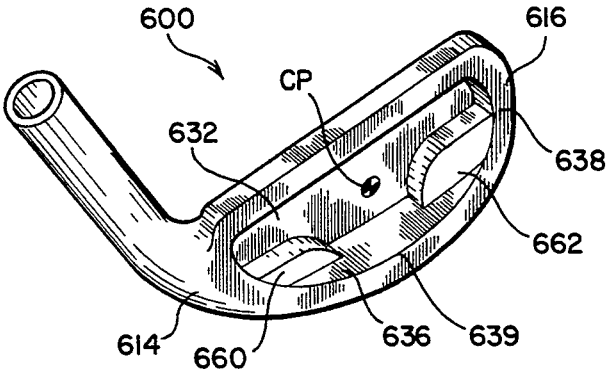
FIG. 8 is a rear perspective view of a seventh embodiment of the present invention.

FIG. 8 illustrates a seventh embodiment of the invention. The club head 600 is similar to the embodiment illustrated in FIG. 6 except that the weight members 660, 662 extend only partially from the rear club face 632 along the shelf-like surface 636 toward the edge 639 of the peripheral mass 638. The weight members 660, 662 have an arched cross section and are located on opposite sides of the center of percussion CP at the heel 614 and toe 616 portions, respectively. In this embodiment the weight member at the toe portion is larger than the weight member of the heel portion.

Figure 9:
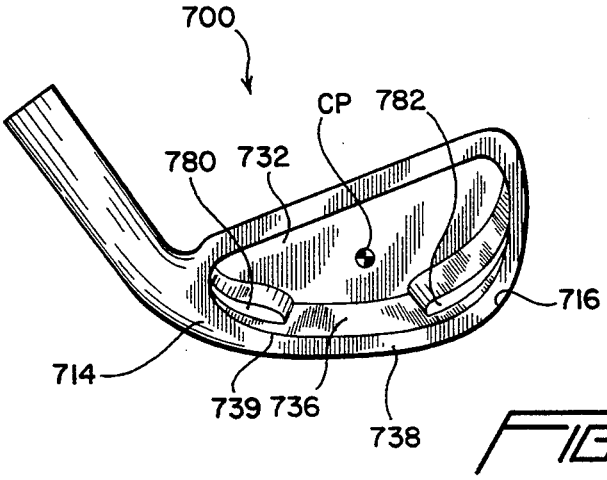
FIG. 9 is a rear perspective view of an eighth embodiment of the present invention.

FIG. 9 shows another embodiment of the present invention. The golf club head 700 includes a pair of weight members 780, 782 which extend to the heel 714 and toe 716 portions, respectively. The weight members 714, 716 have a narrow, elliptical cross section, with the mass increasing toward the center of percussion. The weight members extend from the rear club face 732 along the shelf-like surface 736 to a position short of intersecting with the edge 739 of the peripheral mass 738.

The various embodiments of the golf club heads of the present invention can be incorporated into an entire set of iron-type clubs, typically including a 1 iron through a pitching wedge, lob wedge, and/or sand wedge. Although the invention is illustrated with cavity-back clubs, it can also be applied to other types of iron-type club heads.

It will be apparent to those skilled in the art that other modifications and variations can be made in the golf club head of the present invention without departing from the spirit or scope of the invention. Thus, it is intended that the present invention cover the modifications and variations of this invention provided these come within the scope of the appended claims and their equivalents.

I claim:

1. An iron type golf club head for hitting a golf ball comprising:

a golf club head body having a heel portion, a toe portion, a sole, a top ridge, a rear club face, and a planar, lofted ball striking face having a loft greater than 12 degrees, the ball striking face intersecting with a forwardmost progression of said sole to define a leading edge of the ball striking face of said golf club head, the bottom of said sole extending rearwardly from said leading edge and the top of said sole extending rearwardly from said ball striking face to form a shelf having an upper surface and intersecting with the rear club face;

at least two opposing weight members fixed to a portion of the rear club face and extending outwardly and rearwardly from the rear club face and along a portion of the upper surface of the shelf, the weight members being located apart from each other and on opposite sides of the center of percussion of the club head, the weight members extending upwardly from the upper surface of the shelf and along the rear club face to respective points spaced below the top ridge, thereby providing balanced, increased mass at a bottom portion of the club head; and a pair of runners extending outwardly and rearwardly from the sole, said weight members being respectively aligned with said runners.

2. The golf club head of claim 1 wherein said opposing weight members do not extend upwardly beyond the upper $\frac{1}{2}$ of the club head in a sole to top ridge direction.

3. The golf club head of claim 1 wherein the weight members do not extend beyond the club head's center of percussion in a sole to top ridge direction.

4. The golf club head of claim 1 wherein the club head includes perimeter weighting extending from the rear club face of the club head at the toe and heel portions of the club, said weight members being spaced from the perimeter weighting at both the toe and the heel portions.

5. The golf club head of claim 1 wherein the club head includes perimeter weighting extending from the rear club face of the club head at the toe and heel portions of the club, said weight members respectively extending into the perimeter weighting at both the toe and the heel portions.

6. The golf club head of claim 1 wherein said weight members have a height in a sole to top ridge direction of at least $\frac{3}{8}$ of an inch.

7. The golf club head of claim 1 wherein the weight members have a width in a heel to toe direction of at least $\frac{3}{8}$ of an inch.

8. The golf club head of claim 1 wherein the height of each weight member progressively decreases as it extends rearwardly from the rear club face.

* * * * *

UNITED STATES PATENT AND TRADEMARK OFFICE

CERTIFICATE OF CORRECTION

PATENT NO. : 5,390,924

DATED : February 21, 1995

INVENTOR(S) : Anthony J. Antonious

It is certified that error appears in the above-identified patent and that said Letters Patent is hereby corrected as shown below:

On title page, item [54] and col. 1,

In line 1 of the title, "GOLD" should read --GOLF--.

Signed and Sealed this

Twenty-fifth Day of April, 1995

*Attest:*

Bruce Lehman

BRUCE LEHMAN

*Attesting Officer*

*Commissioner of Patents and Trademarks*